United States Patent [19]

Verweel et al.

[11] 4,428,736

[45] Jan. 31, 1984

[54] METHODS OF MANUFACTURING A COLOR DISPLAY TUBE HAVING A MAGNETIC GUADRUPOLE POST-FOCUSING MASK

[75] Inventors: Jan Verweel; Hinne Zijlstra, both of Eindhoven, Netherlands

[73] Assignee: U.S. Philips Corporation, New York, N.Y.

[21] Appl. No.: 250,496

[22] Filed: Apr. 2, 1981

[30] Foreign Application Priority Data

Apr. 21, 1980 [NL] Netherlands ..... 8002303

[51] Int. Cl.[3] ..... H01J 29/07; H01J 9/00

[52] U.S. Cl. ..... 445/47; 335/284; 313/403

[58] Field of Search ..... 29/25.11, 25.17, 607; 335/284; 313/402, 403

[56] References Cited

U.S. PATENT DOCUMENTS 2,442,808 6/1948 Granberry ..... 335/284

4,135,111 1/1979 Verweel ..... 313/403

4,339,688 7/1982 Verweel ..... 313/403

*Primary Examiner*—Kenneth J. Ramsey

*Attorney, Agent, or Firm*—Joseph P. Abate

[57] ABSTRACT

In a first method, a meander-shaped coil (20,21) is provided on each side of the mask (7) having apertures (9). The coil (21) is oriented perpendicularly relative to the coil (21). If a current flows through the coils (20,21) in the correct direction, a magnetic quadrupole is formed along circumference of each aperture (9). In a second method, a holder (30,31) with permanent magnetic strips (32) is provided on each side of the mask (7). The strips (32) in the one holder (30) are oriented perpendicularly relative to the strips in the other holder (31) A coil 40 is provided around the holders 30 and 31 with which a decaying magnetic alternating field is generated which initially drives the material of the mask (7) on both sides of the hysteresis curve into saturation. After the decay of said alternating field, a magnetic quadrupole is present along the circumference of each aperture (9).

8 Claims, 9 Drawing Figures

METHODS OF MANUFACTURING A COLOR DISPLAY TUBE HAVING A MAGNETIC GUADRUPOLE POST-FOCUSING MASK

BACKGROUND OF THE INVENTION

The present invention relates to methods of manufacturing a color display tube having a magnetic quadrupole post-focusing mask formed by a plate of a magnetizable material having rows of apertures provided though oppositely facing sides of the plate, which plate magnetized so that, cyclically, a north pole, a south pole, a north pole and a south pole are formed along the circumference of each aperture.

The invention also relates to devices for carrying out such methods.

Such a method of manufacturing a color display tube having a magnetic quadrupole post-focusing mask is disclosed in U.S. Pat. No. 4,135,111 to Verweel issued Jan. 16, 1979. The object of magnetic post-focusing is to increase the transmission of the mask. In tubes without post-focusing, a very large part, for example 80 to 85%, of the electrons is intercepted by the so-called shadow mask. By using magnetic post-focusing, the apertures in the mask can be enlarged because, as a result of the focusing in the apertures, the electron spots on the screen are considerably smaller than the apertures so that sufficient space is still present between the electron spots of the various electron beams to avoid their overlapping onto adjacent phosphors.

In known tubes, the mask is formed by a magnetizable plate which has a large number of apertures and which is magnetized so that, cyclically, a north pole, a south pole, a north pole and a south pole are present along the circumference of each aperture. The plate may be manufactured from a ferromagnetic material or frm a nonferromagnetic material on which a layer of magnetizable material has been provided. A magnetic quadrupole lens is present in each of the apertures. Such a lens focuses the electron beam in one direction and defocuses it in a direction at right angles thereto. Because the magnetic field is perpendicular to the electron beam, quadrupole lenses are comparatively very strong so that a comparatively small magnetization will suffice.

The magnetization of such a mask in the above-mentioned U.S. Pat. No. 4,135,111 is carried out by means of one or more writing heads each having four pole shoes comprising coils. The pole shoes are magnetically connected by a yoke. If an electric current flows through the coils in the correct direction, cyclically, a north pole, a south pole, a north pole and a south pole are formed along the circumference of each aperture. The writing head is constructed so that the pole shoes are placed in the facing corners of four adjacent apertures. A result of this is that four poles, two north poles and two south poles, are formed at a small distance from each other. This formation weakens the post-focusing action of the apertures. Oppositely directed poles of adjacent apertures should, therefore, be provided as far remote from each other as possible.

Moreover, in the known method, the longitudinal direction of the rows of apertures is the same as the longitudinal direction of the phosphor lines on the display screen. Further, the poles are present at the corners of each aperture. This means that the longitudinal direction of the linear spot formed by the quadrupole lens, which spot direction should be the same as the longitudnal direction of the phosphor lines, is situated in the longitudinal direction of the rows of apertures. The distance between two phosphor lines luminescing in the same color is, in this case, equal to the pitch between the rows of apertures.

The distance between the phosphor lines and, hence, the number of phosphor lines on the display screen can be increased by causing the longitudinal direction of the rows of apertures to vary at an angle of about 45° with the longitudinal direction of the phosphor lines and causing the longitudinal direction of the linear spot to vary at an angle of approximately 45° with the longitudinal direction of the rows of apertures, i.e., in the longitudinal direction of the phosphor lines on the display screen.

SUMMARY OF THE INVENTION

It is therefore the object of the invention to provide methods of manufacturing a color display tube having a magnetic quadrupole post-focusing mask in which oppositely directed poles of adjacent apertures are situated as far as possible from each other and in which the longitudnal direction of the spot formed by the quadrupole lens encloses an angle of approximately 45° with a longitudinal direction of the rows of apertures.

Another object of the invention is to provide devices for carrying out the methods.

According to the invention, a first method of a kind mentioned in the opening paragraph is characterized in that the the magnetizing step includes providing two mutually substantially perpendicularly oriented sets of parallel conductors, one set on each side of the plate, each set being provided such that two conductors of each set extend along the material between two rows of apertures, and causing a current in each set to flow in mutually opposite directions through the two conductors. If the currents traverse the conductors in the correct direction, a magnetic quadrupole is formed along each aperture in the mask in which oppositely directed poles are situated at an angle of 90° from each other in such manner that the longitudinal direction of the spot of the electron beam encloses an angle of approximately 45° with the longitudinal direction of the rows of apertures.

A further embodiment of said method is characterized in that the conductors extending between two rows of apertures are interconnected at one end and, at the other end, are each connected to a conductor extending along either side of the two rows of apertures. In this manner, the conductors are connected in a meander-like manner and two electric connections per set of conductors will suffice.

Still a further embodiment is characterized in that the distance between the center lines of the conductors extending between two rows of apertures is substantially equal to the width of the material between the rows of apertures. In this case, the current strength necessary for the magnetization is smaller than in the case in which the wires extend over the apertures at a distance situated farther away from the edges of the apertures. Moreover, it has been found in this embodiment that the aberrations of the spot of the focused electron beam are smaller.

A device for carrying out such a method is characterized in that the device comprises at least two mutually substantially perpendicularly oriented coils which are each formed by a set of parallel conductors which are connected in the form of a meander.

A second method of a kind mentioned in the opening paragraph is characterized according to the invention in that the magnetization step is carried out by providing, on each side of the plate, two mutually substantially perpendicularly oriented sets of permanent magnetic strips having alternately oppositely directed poles on their sides facing the plate; in each set, a strip extends on each side of a row apertures and a strip extends over a row of apertures. The step further includes providing a coil around at least a part of the plate with the strips provided thereon, by means of which coil a decaying magnetic alternating field is generated at the area of the plate. The magnetic alternating field initially drives the magnetizable material of the plate on both sides of the hysteresis curve into saturation. In this method, a decaying magnetic alternating field in which the magnetizable material is initially driven into saturation on either side of the hysteresis curve is superimposed on the constant magnetic field generated by the magnetic strips.

After the decay of the magnetic alternating field, a magnetization remains in the material which is the same as the magnetization generated by the magnetic strips. As a result of this, the plate is permanently magnetized in such manner that, along the circumference or perimeter of each aperture, a magnetic quadrupole is formed in which longitudinal direction of the spot makes an angle of approximately 45° with the longitudinal direction of the rows of apertures.

A further embodiment with which the plate is magnetized entirely is characterized in that a coil is provided around the whole plate with strips provided thereon through which coil an alternating current with decreasing amplitude is passed.

Another embodiment with which the plate is magnetized in parts is characterized in that a coil is provided around a part of the plate with strips provided thereon, through which coil an alternating current with a constant amplitude is passed and in that the plate with strips provided thereon is passed, through the coil. As a result of this, each part of the plate experiences a decaying magnetic alternating field.

The magnetic strips are preferably manufactured from $SmCo_5$ which is strongly permanent magnetic material.

A device for carrying out such a method is characterized in that the device has two holders on which a number of parallel permanent magnetic strips are provided. The strips alternately have oppositely directed poles on their sides remote from a holder. The device is provided with a coil to generate a magnetic field.

BRIEF DESCRIPTION OF THE DRAWING

The invention wil now be described in greater detail, by way in example, with reference to the accompanying drawing, of which.

DESCRIPTION OF THE PREFERRED EMBODIMENTS

Figure 1:
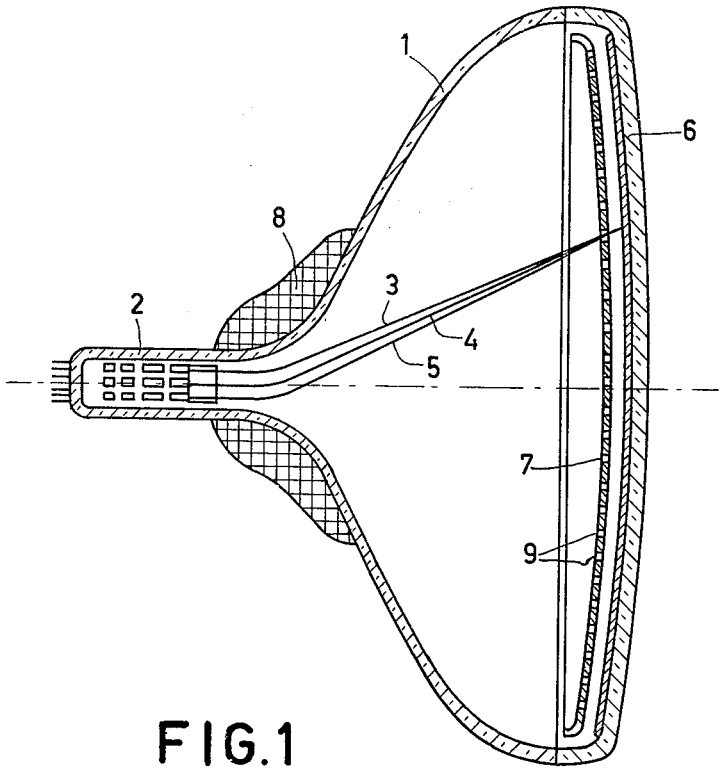
FIG. 1 is a sectional view of a color display tube having a magnetic quadrupole post-focusing mask.

The tube shown in FIG. 1 comprises a glass envelope 1, means 2 for generating three electron beams 3,4 and 5, a display screen 6, a magnetic quadrupole post-focusing mask 7 and deflection coils 8. The electron beams 3,4 and 5 are generated in one plane, the plane of the drawing in FIG. 1, and are deflected over the display screen 6 by means of the deflection coils 8. The display screen 6 comprises a large number of phosphor strips luminescing in red, green and blue. These strips have a longitudinal direction which is perpendicular to the plane of the drawing of FIG. 1. For normal usage of the tube, the phosphor strips are vertical and FIG. 1, thus, is a horizontal cross-sectional view of the tube. The mask 7 which will be described in greater detail with reference to FIGS. 2 and 3 comprises a large number of apertures 9 which are shown diagrammatically in FIG. 1. A magnetic quadrupole lens is formed in each of the apertures 9. The three electron beams 3, 4 and 5 pass through the apertures 9 at a small angle with each other and consequently each impinges only on phosphor strips of one color. The apertures 9 in the mask 7 are thus positioned very accurately relative to the phosphor strips of the display screen 6.

Figure 2:
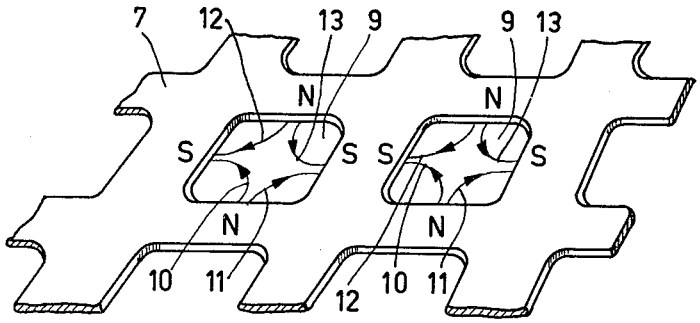
FIG. 2 is a perspective view of a part of the mask shown in FIG. 1.

FIG. 2 is a perspective elevational view of a part of the mask 7 of the tube shown in FIG. 1. The mask 7 comprises a plate of a permanent magnetic material, for example, a rollable steel which can be etched for the manufacture of the apertures 9. Such material includes, for example, in percent by weight, 20% iron, 20% nickel and 60% copper or 56% iron, 27% chromium, 15% cobalt, 1% niobium and 1% aluminium, or metal used for magnetic recording (for example $\gamma$-$Fe_2O_3$ or 90% cobalt and 10% phosphor or 90% nickel and 10% phosphor) on a non-ferromagnetic carrier of, for example, aluminium. The plate is then magnetized in such manner that the magnetic poles shown in FIG. 2 by N and S are obtained. The four magnetic poles (N-S-N-S) constitute a magnetic quadrupole field of which a few field lines 10, 11, 12, 13 are shown in the figure. The way in which the magnetization is carried out will be explained in detail with references to FIGS. 4 and 5. In FIG. 2, the apertures 9 are square with rounded corners. However, the invention is not restricted to this shape of apertures. For example, the apertures 9 may alternatively be circular or hexagonal with or without rounded corners. In the FIG. 2 embodiment, the thickness of the mask 7 is equal to 0.15 mm and the apertures 9 have the dimensions $0.6\times0.6$ mm, the pitch between apertures being 0.8 mm.

The principle of a magnetic quadrupole lens will be explained with reference to FIG. 3*a* which shows diagrammatically such a magnetic quadrupole lens in an aperture 9 of the mask 7. The variation of the magnetization along the edge of the aperture 9 is denoted by N,S,N,S, in such manner that a quadrupole field is formed. The electron beam which passes through the aperture 9 is focused in the horizontally drawn plane and is defocused in the vertically drawn plane so that, when the display screen is exactly at the horizontal focal point, the electron spot 19 is formed. The cross section of the electron beam is thus elongated in the vertical direction and is made narrower in the horizontal direction. In order to prevent the formation of a so-called focus ring on the display screen, it is preferable not to focus exactly on the display screen 6 so that a slightly wider electron spot is formed.

The fact that the electron beam passes through the aperture 9 at a small angle has only a minor influence on the focusing so that the color selection of the three electron beams 3,4 and 5 takes place in quite an analogous manner as in the known shadow mask tube. As a result of the strong focusing, however, the aperture 9 can be much larger than in known shadow mask tubes so that many more electrons impinge on the display screen 6 and a brighter picture is formed. The defocusing in the vertical direction need not be objectionable when phosphor strips are used which are parallel to the elongate direction of the spot 19.

Figure 3A:
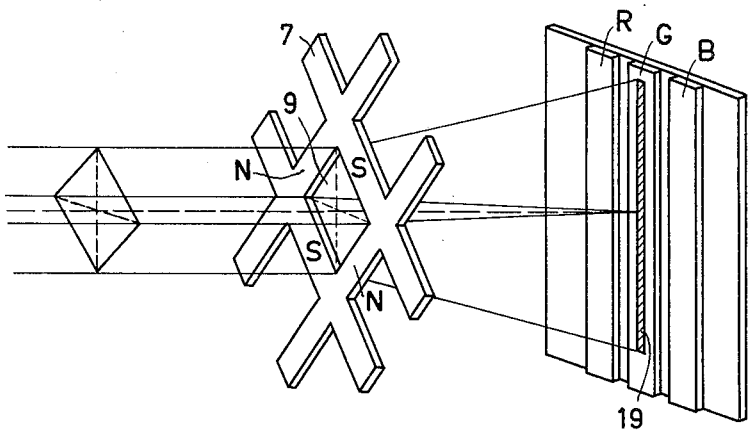
FIG. 3*a* is a diagram explaining the principle of focusing by means of a magnetic quadrupole lens.

By arranging the rows of apertures in such manner that the longitudinal direction of the rows encloses an angle of 45° with the phosphor lines (as shown in FIG. 3*a*) and by placing the poles on the centers of the sides of each aperture, the number of phosphor lines on the display screen can be increased. This will be described in greater detail with reference to FIGS. 3*b* and 3*c*.

Figure 3B:
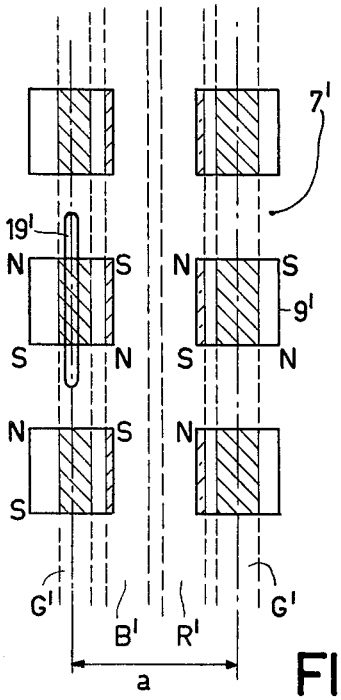
FIGS. 3*b* and 3*c* are diagrams explaining the increased number of phosphor lines on the display screen in a mask manufactured according to the invention as compared with a prior art mask.

FIG. 3*b* shows the configuration as described in the previously mentioned U.S. Pat. No. 4,135,111 to Verweel issued Jan. 16, 1979. The longitudinal direction of the rows of apertures is the same as the longitudinal direction of the phosphor lines (R′, G′ and B′) on the display screen. The poles, N,S,N and S, are present at the corners of each aperture 9′. The longitudinal direction of the linear spot 19′ varies in the longitudinal direction of the phosphor lines (R′, G′, and B′). The distance between two phosphor lines luminescing in the same color is equal to the pitch a of the rows of apertures.

Figure 3C:
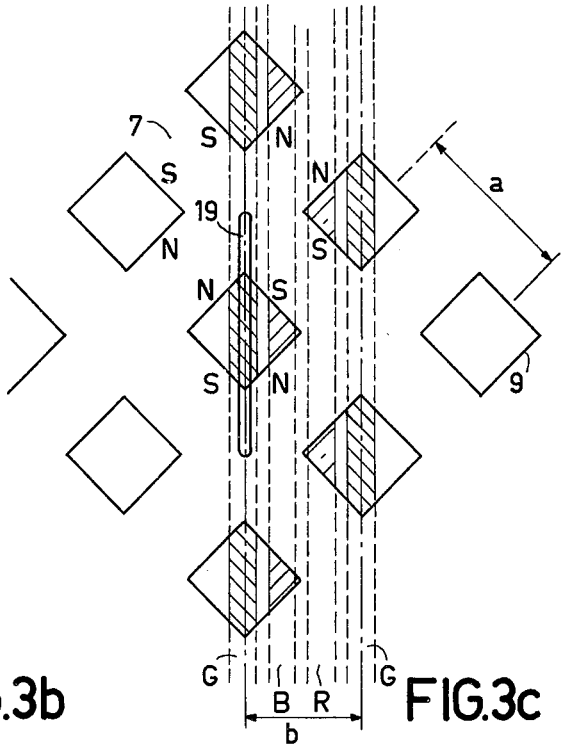

FIG. 3*c* shows the configuration obtained when the mask is manufactured according to the invention. The longitudinal direction of the rows of apertures 9 makes an angle of 45° with the longitudinal direction of the phosphor lines (R, G and B) on the display screen. The poles are present on the centers of the sides of each aperture 9. The longitudinal direction of the linear spot 19 varies in the longitudinal direction of the phosphor lines. The pitch b between two phosphor lines luminescing in the same color is smaller than the pitch a of the rows of apertures 9. As a result of this, a larger number of phosphor lines can be provided on the display screen.

A method of manufacturing a color display tube having a mask with a large number of magnetic quadrupole lenses can be realized in two manners.

Figure 4A:
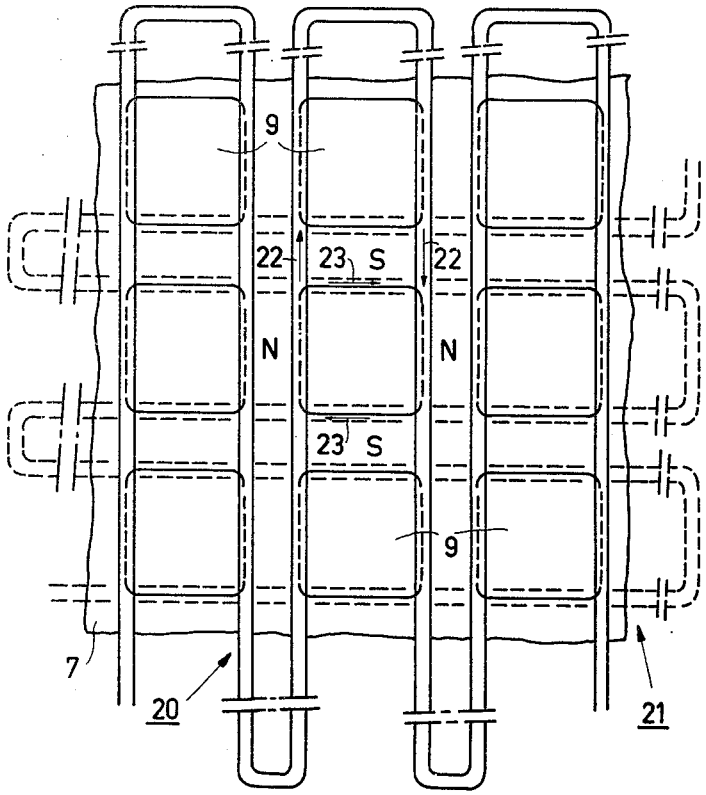
FIG. 4*a* diagrammatically explains an embodiment of a first method of manufacturing a color display tube according to the invention.

An embodiment of a first method will be described with reference to FIG. 4*a* which is an elevational view of a part of the mask 7 with apertures 9. The mask 7 is magnetized in parts, although the mask 7 may alternatively be magnetized as a whole. The magnetization is carried out by means of devices which will be described with references to FIG. 4*b*. For clarity, FIG. 4*a* shows only the components which are essential for the magnetization. A coil 20 is provided against one side of the mask 7 and an identical coil 21 is provided against the opposite side of the mask 7. The coil 21 is positioned at right angles to the coil 20. Each of the coils 20 and 21 is formed by a set of parallel conductors. The conductors are arranged so that two conductors extend along the material between two rows of apertures. At one end, said conductors are interconnected. At the other end, each of the conductors is connected to an adjacent conductor extending along the other side of an intervening row of apertures. A current then flows through the coils 20 and 21 in a direction denoted in FIG. 4*a* by the arrows 22 and arrows 23, respectively.

The mask 7 is now magnetized permanently by the magnetic fields generated by the currents in such a manner that, around each aperture 9, cyclically, a north pole, a south pole, a north pole and a south pole are formed. In FIG. 4*a*, these poles are denoted for the central aperture 9 by N-S-N-S. The poles are present midway along the sides of each aperture 9. As a result, the elongate spot formed by the quadrupole lens extends along a diagonal of an aperture 9 so that a larger number of phosphor lines can be provided in the horizontal direction than in the case when the poles are situated at the corner points of each aperture 9. As is shown in FIG. 4*a*, the conductors extend slightly over the edges of the aperture 9. This has the advantage that less current is necessary for the magnetization of the material and, in addition, that aberrations of the spot of the focused electron beam are smaller than in the case in which the distance between the wires is much larger.

The distance betwen the center lines of the conductors, therefore, is preferably not much larger than the width of the material of the mask 7 between two rows of apertures 9.

Figure 4B:
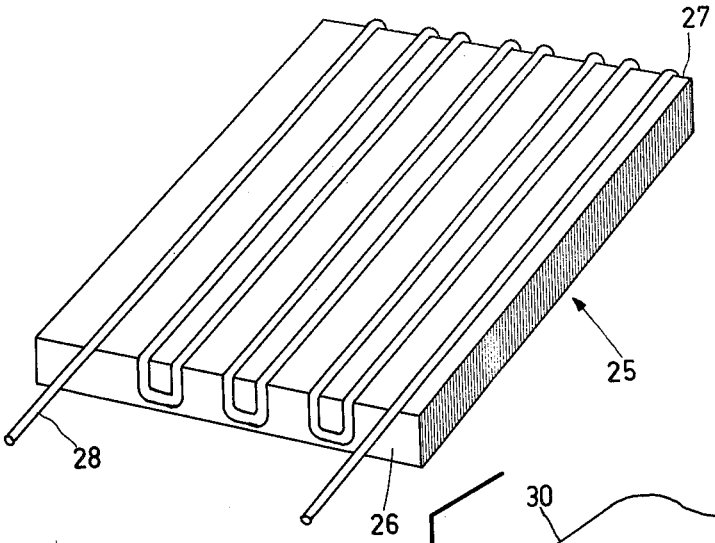
FIG. 4*b* shows a device for the method explained with reference to FIG. 4*a*, and FIGS. 5*a* and 5*b* show an embodiment of a second method of manufacturing a color display tube in accordance with the invention.

FIG. 4*b* shows diagrammatically a device for carrying out the method described with reference to FIG. 4*a* can be carried out. The mutual distance between the parallel conductors should correspond very accurately with the distance between the rows of apertures 9 in the mask 7. For this purpose, a meander-like coil 28 is connected to a block 25 of synthetic resin by means of an adhesive. In order to have no overlap problems when the mask 7 is magnetized in parts, the ends of the conductors are bent over and bonded to the side faces 26 and 27 of the block 25.

Figure 5A:
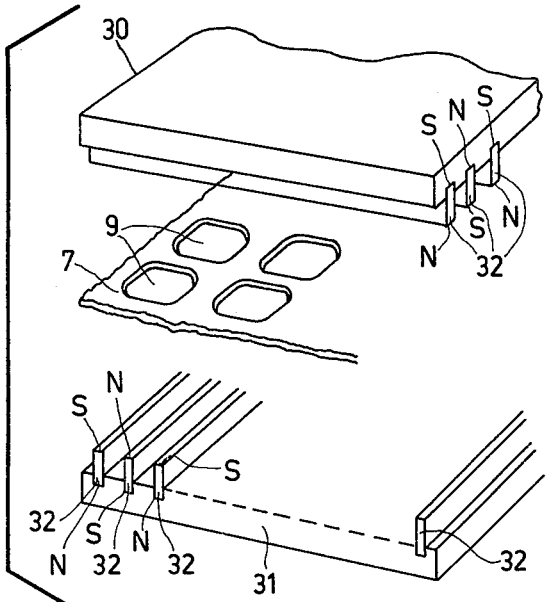

An embodiment of a second method will be described with references to FIGS. 5*a* and 5*b*. FIG. 5*a* is a perspective view of a part of the mask 7 with apertures 9. On the upper and lower sides of the mask 7, two holders 30 and 31 are shown at some distance. Each of the two holders 30 and 31 comprises a number of permanent magnetic strips 32 which are manufactured from $SmCo_5$. The strips 32 in the holder 30 cross the strips 32 in the holder 31 at right angles. The strips 32 are provided in the holders 30 and 31 in such manner that the poles of the strips 32 are alternately directed oppositely. In the figure, the north and south poles are denoted by N and S, respectively. The mutual pitch of the strips 32 is such that, if the holders 30 and 31 with strips 32 are placed on the mask 7, a strip with equally directed poles is present on each side of a row of apertures 9 and a strip with oppositely directed poles is present between two strips. In the shown embodiment of the holder 30, a strip 32 having a north pole on the side facing the mask 7 is present on each side of each row of apertures 9 and, between said strips, a strip 32 having a south pole on the side facing the mask 7 is present. In the holder 31, a strip 32 having a south pole on the side facing the mask 7 is present on each side of each row of apertures 9 and, between said strips 32, a strip having a north pole on the side facing the plate 7 is present.

Figure 5B:
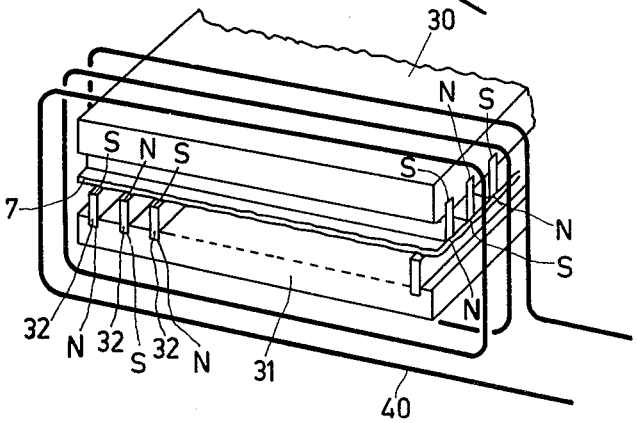

FIG. 5*b* shows the situation in which the holders 30 and 31 are provided on the plate 7. The plate 7, with holders 30 and 31, is passed through a coil 40. A constant magnetic alternating field of, for example, 50 Hz is generated by means of the coil 40. The strenght of the magnetic alternating field must initially be such that the material of the plate 7, on both sides of the hysteresis curve, is driven into saturation. The magnetic alternating field, however, should initially not be so strong that the magnetization of the $SmCo_5$ strips 32 is disturbed. A part of the plate 7 passed through the coil 40 experiences a magnetic alternating field which decreases in strenght. After decaying of the magnetic alternating field, a magnetization remains in the plate 7 which magnetization is the same as the magnetization generated by the strips 32. In this manner, a north pole, a south pole, a north pole and a south pole are cyclically formed around each aperture.

The plate 7 may alternatively be magnetized entirely by providing a coil around the whole plate with strips provided thereon. The plate is magnetized by generating a decaying magnetic alternating field by means of the coil, for example, by passing through the coil an alternating current of 50 Hz decreasing in amplitude. After the decay of the magnetic alternating field, a magnetic quadrupole lens is formed around each aperture.

While there has been shown and described what is at present considered the preferred embodiments of the methods according to the invention, it will be apparent to those skilled in the art that various changes and modifications may be made therein without departing from the spirit and scope of the invention as defined by the appended claims.

What is claimed is:

1. A method of manufacturing a color display tube having a magnetic quadrupole post-focusing mask formed by a plate of magnetizable material having rows of apertures provided through oppositely facing sides of the plate, which plate is magnetized so that, cyclically, a north pole, a south pole, a north pole and a south pole are formed along the circumference of each aperture, characterized in that the magnetizing step includes providing two mutually substantially perpendicularly oriented sets of parallel conductors, one set on each side of the plate, each set being provided such that two conductors extend along the material between two rows of apertures, and the magnetizing step also includes causing a current in each set to flow in mutually opposite directions through the two conductors.

2. A method as claimed in claim 1, characterized in that the conductors extending along the plate material between two rows of apertures are interconnected at one end and, at the other end, are each connected to a respective conductor extending along each side of the two rows of apertures.

3. A method as claimed in claims 1 or 2, characterized in that the distance between the center lines of the conductors extending along the plate material between two rows of apertures is substantially equal to the width of the plate material between the rows of apertures.

4. A method of manufacturing a color display tube having a magnetic quadrupole post-focusing mask formed by a plate of magnetizable material having rows of apertures provided through oppositely facing sides of the plate, which plate is magnetized so that, along the circumference of each aperture, cyclically, a north pole, a south pole, a north pole and a south pole are formed, characterized in that the magnetizing step includes providing, on the respective sides of the plate, two mutually substantially perpendicularly oriented sets of permanent magnetic strips having alternately oppositely directed poles on the strip sides facing the plate, each set being provided such that a strip extends along each side of a row of apertures and a strip extends over a row of apertures, and the magnetizing step also includes providing a coil around at least a part of the plate with the strips provided thereon and generating a decaying magnetic alternating field at the area of the plate, the magnetic alternating field having a strength such that the field initially drives the magnetizable material of the plate, on both sides of the hysteresis curve, into saturation.

5. A method as claimed in claim 4, characterized in that a coil is provided around the whole plate with strips provided thereon, through which coil an alternating current with decreasing amplitude is passed.

6. A method as claimed in claim 4, characterized in that a coil is provided around a part of the plate with strips provided thereon, through which coil an alternating current with a constant amplitude is passed, and in that the plate with strips provided thereon is passed through the coil.

7. A method as claimed in claims 4, 5 or 6, characterized in that the strips are manufactured from $SmCo_5$.

8. A color display tube having a magnetic quadrupole post-focusing mask manufactured by means of a method as claimed in claims 1, 2, 4, 5 or 6.

* * * * *

UNITED STATES PATENT AND TRADEMARK OFFICE

CERTIFICATE OF CORRECTION

PATENT NO. : 4,428,736

DATED : January 31, 1984

INVENTOR(S) : JAN VERWEEL ET AL

It is certified that error appears in the above-identified patent and that said Letters Patent is hereby corrected as shown below:

IN THE TITLE, line 3, Change "GUADRUPOLE" to --QUADRUPOLE--

IN THE ABSTRACT, line 6, after "along" insert --the-- line 10, after "(31)" insert --.--

Col. 1, line 4, change "GUADRUPOLE" to --QUADRUPOLE-- line 36, change "frm" to --from-- line 40, change "passed," to --passed-- line 44, after "which is" insert --a-- line 54, change "wil" to --will-- line 56, after "drawing" change "of" to --in--

UNITED STATES PATENT AND TRADEMARK OFFICE

CERTIFICATE OF CORRECTION

PATENT NO. : 4,428,736

DATED : January 31, 1984

INVENTOR(S) : JAN VERWEEL ET AL

It is certified that error appears in the above-identified patent and that said Letters Patent is hereby corrected as shown below:

Col. 6, line 33, after "FIG. 4a" insert --.-- (period)

line 34, delete "can be carried out."

Col. 7, line 5, change "strenght" to --strength-- line 13, change "strenght" to --strength--

Signed and Sealed this

*Eighth* Day of *October 1985*

[SEAL]

*Attest:*

DONALD J. QUIGG

*Attesting Officer*

*Commissioner of Patents and Trademarks—Designate*